United States Patent [19]

Sato et al.

[11] 3,932,035

[45] Jan. 13, 1976

[54] APPARATUS FOR TRANSFERRING A TONER IMAGE

[75] Inventors: Masamichi Sato, Tucson, Ariz.; Osamu Fukushima, Tokyo, Japan

[73] Assignee: Rank Xerox Ltd., London, England

[22] Filed: Aug. 29, 1974

[21] Appl. No.: 502,250

Related U.S. Application Data

[62] Division of Ser. No. 333,825, Feb. 20, 1973, Pat. No. 3,854,974.

[52] U.S. Cl. ..... 355/3 R; 117/DIG. 8; 96/1.4; 117/DIG. 8

[51] Int. Cl.[2] ..... G03G 15/16

[58] Field of Search ..... 355/3 R, 17; 96/1.4

[56] References Cited

UNITED STATES PATENTS 3,708,286 1/1973 Davies ..... 96/1.4

*Primary Examiner*—Robert P. Greiner
*Attorney, Agent, or Firm*—James J. Ralabate; D. C. Kolasch; A. W. Karambelas

[57] ABSTRACT

A toner image is transferred from a toner substrate to a transfer sheet by bringing the toner substrate and the transfer sheet into face to face contact and applying a vibration thereto, while simultaneously applying pressure and/or an electrical field across the substrate and transfer sheet.

9 Claims, 1 Drawing Figure

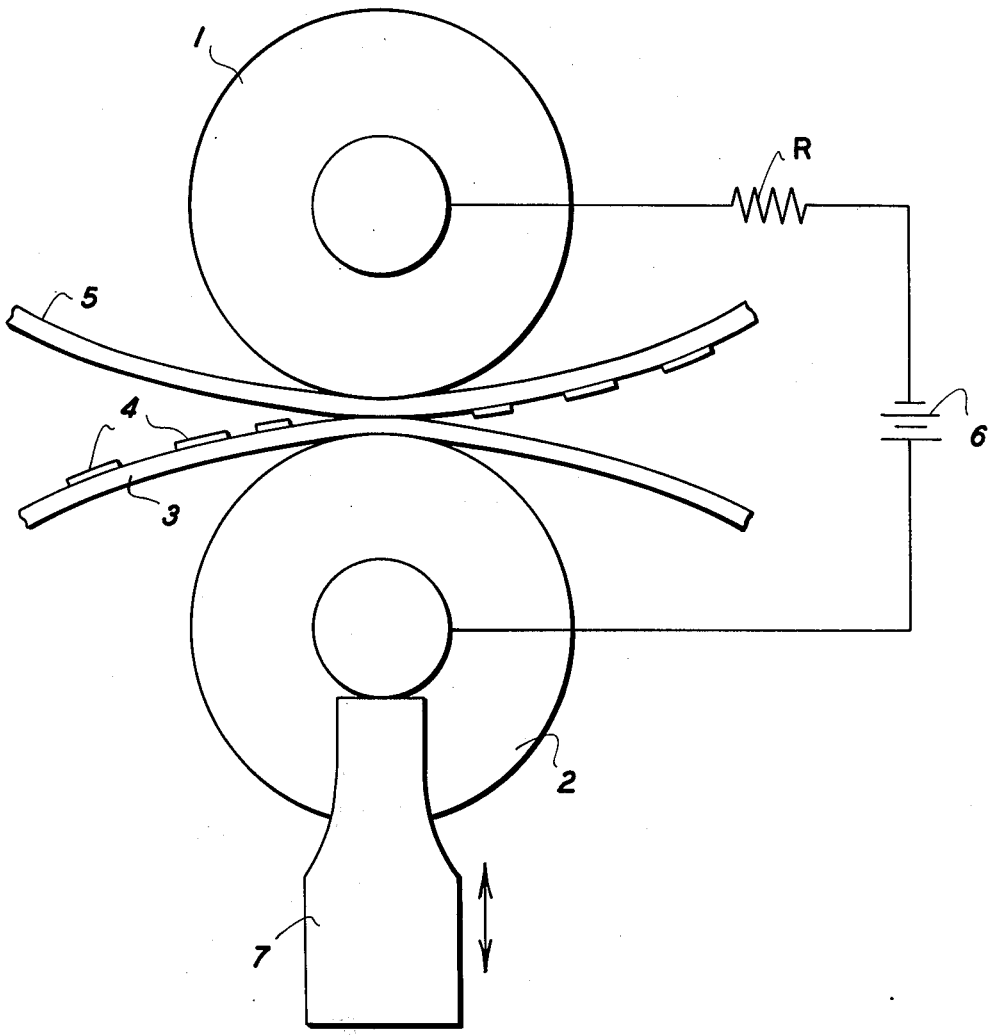
1
R
5
4
6
3
2
7

AN APPARATUS FOR TRANSFERRING A TONER IMAGE

This is a division of application Ser. No. 333,825, filed Feb. 20, 1973 and now U.S. Pat. No. 3,854,974.

BACKGROUND AND SUMMARY OF THE INVENTION

The present invention relates to a method and apparatus for transferring a toner image from a substrate to a receiving element such as a transfer sheet, and is particularly applicable to the transfer of a toner image obtained by an electrophotographic method. More specifically, the present invention is directed to the transfer of a toner image to a receiving element by bringing a substrate carrying said toner image into surface contact with the receiving element, and applying a high frequency vibration thereto, while applying an electric field and/or pressure across the interface.

In the field of electric photography it is often necessary to transfer a toner image developed on one substrate to a transfer sheet. It is well known in the prior art to effect such transfer by employing such methods as electrostatic attraction, mechanical pressing and tacky adhesion. In the electrostatic method, a transfer sheet is brought into contact with a toner substrate and a corona discharge is applied to the rear surface of the transfer sheet to attract the toner thereto. In the mechanical pressing method, a toner substrate is disposed on a transfer sheet and the composite is conveyed through a pair of opposing pressure rollers, whereby the toner particles are caused to adhere to the transfer sheet. The tacky adhesion method is one in which a transfer sheet containing a tacky layer is pressed against the surface of the toner substrate, to transfer the toner image from said substrate to the transfer sheet adhesively.

According to the present invention, an effective method and apparatus has been developed for transferring a toner image from a toner substrate to a transfer sheet, wherein the toner substrate and transfer sheet are brought together, in face to face contact, and a high frequency low amplitude vibration is applied to said substrate and sheet while they are in contact with each other. Any suitable means can be used to bring the toner substrate and transfer sheet into mutual contact, such as for example, a pair of rollers, and the vibration can be of mechanical or electrical origin. In the case where a pair of opposed rollers are used, the vibration can be applied to the rollers at the point where the toner substrate and the transfer sheet are brought into contact with each other, that is, where they pass through the nip of the rollers. The vibration of the rollers is transferred to said substrate and transfer sheet while they are in contact with each other. Simultaneously with the vibratory energy an electrical voltage and/or mechanical pressure is applied across the toner substrate and the transfer sheet while they are in contact with each other, and this operation effects a uniform transfer of the toner image from the toner substrate to the transfer sheet.

It is therefore an object of the present invention to provide a method and apparatus for transferring a toner image from a toner substrate to a receiving element, wherein a vibration is applied to said substrate and element while they are in contact with each other.

Another object of the present invention is to provide a method and apparatus for transferring a toner image from a toner substrate to a transfer sheet wherein, in addition to said vibration, the toner substrate and the transfer sheet are pressed together and/or a voltage is applied thereto.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow in conjunction with the accompanying drawings, which are given by way of illustration only and thus are not limitative of the present invention, and wherein the single FIGURE of the present invention shows a schematic illustration of a side view of an apparatus for transferring a toner image from a toner substrate to a transfer sheet.

DESCRIPTION OF THE PREFERRED EMBODIMENTS

In the embodiment of the present invention shown in the drawing, a toner substrate 3 containing toner image 4 formed thereon is conveyed together with a transfer sheet 5 through the nip of a pair of opposed pinch rollers 1 and 2. A vibrator 7 bears against the axle of roll 2 to produce a vibration which, in the embodiment shown, is substantially perpendicular to the direction of travel of the toner substrate and transfer sheet and is applied to the substrate 3 and sheet 5 at the nip of the rollers. Alternatively, the vibrator may be positioned to contact any part of roller 2, or any part of roller 1 if desired. The amplitude of vibration of the roller can be varied widely, though it is preferred to be in the range of about several microns to several hundred microns. The frequency of vibration is somewhat dependent upon the running speed of the rollers. For example, where the running speed of the rollers is slow, the frequency of vibration may also be relatively small, whereas when the rollers are running at a fast speed, the frequency would have to be proportionately greater. When the rollers are running at a speed of about 5 cm/sec., the frequency of vibration is preferred to be about 1,000 $H_z$ or more. When the rollers are running at a speed of about 5 cm/sec., but the frequency is only about 100 $H_z$, the length of each cycle as projected on the transfer sheet would be about 0.5 mm, which would cause toner transfer in streaks of 0.5 mm intervals, giving an unacceptable print. If, however, the frequency is increased to about 1,000 $H_z$, it is difficult to see any streaks because the length of each cycle is reduced to about 0.05 mm.

The vibrator may be driven by a piezoelectric element or a magnetostrictive element to which an alternating current is applied in order to obtain the desired vibration. Alternatively, the vibrator may utilize a mechanical drive.

Toner transfer from the substrate 3 to the transfer sheet 5 is effected by a combination of the vibratory action above-described with the simultaneous application of mechanical pressure and/or an electrical voltage across the toner substrate and transfer sheet at the point of toner transfer. For example, in the case where superimposed rollers are used, the pressure is applied between the rollers at the point of contact, and can be the result simply of the weight of the upper roller disposed upon the lower roller, of if an additional force is desired, the upper roller can be weighted. An electrical field across the nip of rollers 1 and 2 can be provided by dc power source 6. The polarity of the power source is selected to provide an opposite polarity on roll 1 backing the transfer sheet 5, from the residual electrostatic charge on the toner particles 4. A protective resistance R is preferably inserted in the electrical circuit which may have a value of between 20 and 1,000 kilo-ohms.

The pinch rollers 1 and 2 may, for example, be made of steel, or alternatively, one of the rollers can be a metal roller whereas the other can comprise a metal core covered with an electroconductive material, a semi-conductive material or an insulating rubber. The toner substrate 3 may comprise, for example, a sheet of paper coated with a mixture of photoconductive zinc oxide powder and an insulating resin. However, many other electrophotographic materials can be used. The toner image 4 may be formed on substrate 3 by either a dry or liquid development process. The transfer sheet 5 may be, for example, an ordinary bond paper, a plastic film, a sheet of paper provided with a plastic coating or film, or other suitable receiving material.

The following specific examples are given merely as illustrative of the present invention and are not to be considered as limiting.

EXAMPLE I

The toner image transfer apparatus comprises two superimposed stainless steel rollers, each having a smooth surface and a diameter of 20 mm. The bearing of the lower roller is fixed and is driven at a speed of 2 cm/sec. by means of a motor and through the use of a gear reduction system. The upper roller is supported by a bearing which is freely self adjusting vertically. The upper roller is superimposed on the lower roller and is driven by the friction created by its weight on the lower roller as the latter rotates. When a toner substrate together with a transfer sheet are feed in face to face contact between the two rollers, the upper roller rises from the lower roller a distance equivalent to the thickness of both materials, and a pressure equivalent to the weight of the upper roller is applied between the rollers. The upper roller is negatively charged from a direct current supply of 1500 volts, and for safety purposes a resistance of 100,000 ohms is provided in the electrical circuit. A vibrator is in contact with the shaft of the lower roller for vibrating the same at 1,000 $H_z$.

An electrophotographic substrate comprising electrophotoconductive zinc oxide and an insulating resin coated on a sheet of paper is exposed, and developed with a toner of carbon black coated with a resin and suspended in kerosene, thereby producing a toner image on the substrate. The toner has a positive charge. After the toner image is formed, the toner substrate is brought into contact with a transfer sheet while in a wet state and passed through the above-described transfer apparatus. Ordinary paper is employed as the transfer sheet. Transfer is carried out uniformly and a high quality transferred image is obtained. Good results were also obtained using a vibration frequency of 10 $KH_z$.

EXAMPLE II

With the same equipment and toner substrate as in Example I, a powder image obtained by dry cascade development is transferred from the toner substrate to the transfer sheet. The cascade developer comprises a carrier of glass beads having a diameter of about 0.8 mm and coated with a thin film of nitrocellulose, and the toner powder comprises a mixture of carbon black in polystyrene. Ordinary paper is used as the transfer sheet. Good results are obtained by setting the running speed of the roller at 5 cm/sec. and the vibration frequency at 1,000 $H_z$.

EXAMPLE III

Uniform transfer of the toner image from the toner substrate to the transfer sheet is obtained using the apparatus, method and materials of Example I, except no voltage is applied across the rollers, and instead, the roller pressure is increased by the application of a force of 4 Kg between the rollers. Good results are also obtained with a vibration frequency of 29 $KH_z$.

EXAMPLE IV

In this Example uniform transfer of the toner image from the toner substrate to the transfer sheet is obtained as in Example II, except no voltage is applied across the rollers, and instead, the roller pressure is increased by the application of a force of 6 Kg between the rollers. Also, the upper stainless steel roller in Example II is replaced by a roller having a 10 mm diameter metal core and a 5 mm thick rubber coating. Using a vibration frequency of 1,000 $H_z$, good transfer results were achieved.

Although, in the above Examples, only one pair of rollers is used, a plurality of pairs of rollers may be employed if it is desired to operate at high speeds.

The invention being thus described, it will be obvious to one skilled in the art that the same may be varied in many ways. Such variations are not to be regarded as departures from the spirit and scope of the invention, and all modifications as are embraced by the appended claims are intended to be included within the purview of the present invention.

What is claimed is:

1. An apparatus for transferring a toner image from a toner substrate to a transfer sheet which comprises, contact means for bringing the toner substrate and the transfer sheet into face to face contact with each other, and vibrating means associated with said contact means for producing a vibration at the area of contact between said toner substrate and transfer sheet.

2. The apparatus as set forth in claim 1, wherein the contact means comprises at least one pair of superimposed rollers means.

3. The apparatus as set forth in claim 2, wherein means are provided for rotating at least one of said roller means.

4. The apparatus as set forth in claim 2, wherein the means for rotating the roller means is associated with the lower roller means.

5. The apparatus as set forth in claim 2, wherein at least one of the roller means is a metal roller.

6. The apparatus as set forth in claim 2, wherein at least one of the roller means comprises a metal core covered with a material selected from the group consisting of an electroconductive material, a semi-conductive material, and an insulating rubber.

7. The apparatus as set forth in claim 2, wherein the vibrator means is associated with the axis of the lower roller means.

8. The apparatus as set forth in claim 1, wherein the vibrator means includes a piezoelectric element or a magnetostrictive element associated therewith to which an alternating current is applied.

9. The apparatus as set forth in claim 1, wherein the vibrator means is a mechanical vibrator.

* * * * *